US007132914B2

(12) United States Patent
Nemoto et al.

(10) Patent No.: US 7,132,914 B2
(45) Date of Patent: Nov. 7, 2006

(54) SUPERCONDUCTING MAGNET APPARATUS

(75) Inventors: Kaoru Nemoto, Nagoya (JP); Motohiro Igarashi, Nagoya (JP)

(73) Assignee: Central Japan Railway, Aichi (JP)

( * ) Notice: Subject to any disclaimer, the term of this patent is extended or adjusted under 35 U.S.C. 154(b) by 0 days.

(21) Appl. No.: 10/488,893

(22) PCT Filed: Jul. 28, 2003

(86) PCT No.: PCT/JP03/09550

§ 371 (c)(1),
(2), (4) Date: Mar. 8, 2004

(87) PCT Pub. No.: WO2004/068514

PCT Pub. Date: Aug. 12, 2004

(65) Prior Publication Data

US 2004/0239462 A1 Dec. 2, 2004

(30) Foreign Application Priority Data

Jan. 29, 2003 (JP) ..... 2003-20656

(51) Int. Cl.
*H01F 6/00* (2006.01)

(52) U.S. Cl. ..... 335/216

(58) Field of Classification Search ..... 335/216, 335/299; 324/318–320; 174/15.4–15.5; 82/51.1
See application file for complete search history.

(56) References Cited

U.S. PATENT DOCUMENTS 3,839,689 A * 10/1974 Biltcliffe et al. ..... 335/216
5,099,215 A * 3/1992 Woods et al. ..... 335/216
5,291,168 A * 3/1994 Woods et al. ..... 335/216
5,584,184 A * 12/1996 Inaguchi et al. ..... 62/6

FOREIGN PATENT DOCUMENTS

JP 60-032374 A 2/1985
JP 61-222209 A 10/1986
JP 61-222286 10/1986
JP 63-157903 10/1988

(Continued)

OTHER PUBLICATIONS

Shunji Yamamoto, et al., "Improvement in reliability of a detachable power lead", Lecture briefs at the 42$^{nd}$ meeting on cryogenic engineering and superconductivity for 1989 Autumn, C1–4, P44 (Nov., 1989).

(Continued)

*Primary Examiner*—Ramon M. Barrera
(74) *Attorney, Agent, or Firm*—Sughrue Mion, PLLC

(57) ABSTRACT

A superconducting magnet apparatus which renders possible efficient, accurate and secure connection of a superconducting magnet current lead is provided. In the superconducting magnet apparatus of the present invention, a first current lead (21) and a second current lead (22) which compose a detachable current lead for excitation power supply are automatically attached to/detached from each other via a drive mechanism (30) using a piezoelectric ceramic. Therefore, professional skills in operation and maintenance required for this attachment/detachment operation are not necessary and the apparatus is easy to take care of. Also, no manpower is required even if a plurality of superconducting magnets are excited/demagnetized one after another, and efficient operation of the apparatus is possible. Furthermore, the piezoelectric ceramic is less subject to a magnetic field. Thus, the drive mechanism can be operated properly, and a contact pressure necessary for each attachment/detachment at a contact site between a lead contact portion (21*a*) and an attachment/detachment portion (22*a*) can be accurately obtained.

7 Claims, 7 Drawing Sheets

FOREIGN PATENT DOCUMENTS

| | | | |
|---|---|---|---|
| JP | 03-232205 | A | 10/1991 |
| JP | 05-114754 | | 5/1993 |
| JP | 05-205939 | A | 8/1993 |
| JP | 05-291036 | A | 11/1993 |
| JP | 07-283023 | | 10/1995 |
| JP | 8-46254 | A | 2/1996 |
| JP | 2000-182821 | A | 6/2000 |
| JP | 2000-315606 | A | 11/2000 |

OTHER PUBLICATIONS

Tsukasa Wada, Akio Sato, "Low heat–leaking detachable power lead", Resumes for the meeting on cryogenic engineering B3–7, P136 (May, 1987).

* cited by examiner

SUPERCONDUCTING MAGNET APPARATUS

TECHNICAL FIELD OF THE INVENTION

This invention relates to a superconducting magnet apparatus, more particularly to a superconducting magnet apparatus for switching itself into a persistent current mode using a detachable current lead.

BACKGROUND OF THE INVENTION

Along with improvement in performance of superconducting wire and advance in coil manufacturing technique using such wire, as well as technical developments in related apparatus like a heat-insulating container and a refrigerator, various types of superconducting magnets and application apparatus employing such magnets have been created. Among these, there is a type which is operated in a persistent current mode. Superconducting magnet apparatus for a magnetic resonance imaging system (MRI) and for a magnetically levitated vehicle (Maglev) are examples of the type which have already been put into practical use. These superconducting magnet apparatus supply an electric current from an external excitation power source to a coil which is cooled to extremely low temperature. While a necessary magnetic field is produced, initial and final wiring parts of the coil are short-circuited by way of a superconducting switch, and this makes the apparatus run in a persistent current mode in which the electric current continues to flow into the coil without power supply. After the apparatus is switched into the persistent current mode, power from the external excitation power source is turned off and the apparatus is operated independent from the power source. The superconducting magnet apparatus requires a current lead as the component when the electric current is supplied to this coil. The current lead is a current path which couples a terminal connected to the external excitation power source outside the superconducting magnet to an internal coil. From a thermic point of view, the current lead is also a heat leaking path from the terminal at room temperature to the coil at extremely low temperature, and especially when it is not conducted, the lead is merely a heat transmitting member. It is important to minimize heat leaking into a superconducting magnet in order to reduce freezing costs of the coil. Accordingly, it has been considered to use a detachable current lead in the superconducting magnet apparatus operated in the persistent current mode so that the amount of heat leak is reduced by detaching the current lead when the current lead is not conducted.

There are broadly two types of systems for detaching the detachable current lead. One is a system in that an attachment/detachment portion of the current lead is pulled off from the superconducting magnet (see Documents 1 and 4, for example), and the other is a system in that a gap is created at a contact site between the attachment/detachment portion and a fixed portion (lead contact portion) (see Document 2, for example). FIGS. 7A and 7B respectively show an example of a conceptual constitution of the pull-off system and the gap-creating system.

In the pull-off system shown in FIG. 7A, a first current lead 111 is disposed in a vacuum container 110, and a second current lead 112 is configured so that it can be detached from the first current lead 111. The first current lead 111 is connected to a not shown coil inside the vacuum container 110 on one end, and has a lead contact portion 111*a* on the other end which is exposed to the outside of the vacuum container 110. The second current lead 112 has an attachment/detachment portion 112*a* on one end for detachably connecting itself to the lead contact portion 111*a*, and has an electrode terminal 112*b* on the other end for connecting a lead line which leads to the external excitation power source.

When the external excitation power source supplies the electric current to the coil, the second current lead 112 is inserted to the first current lead 111 for connection, and when the power supply is completed, the second current lead 112 is pulled off from the first current lead 111.

The pull-off system is simple, and thus, a similar constitution has been practiced in the superconducting magnet apparatus for MRI. However, the apparatus employing the pull-off system necessitate professional skills for operation and maintenance of the superconducting magnet, such as in securing a contact pressure at the contact site required for each attachment/detachment upon excitation/demagnetization of the magnet, removal of frost and ice, removal of an insulating coating generated due to oxidization and defacement, or taking measures to prevent the above, etc. The superconducting magnet apparatus according to the pull-off system are not easy to take care of. Therefore, the superconducting magnet apparatus to which such a system can be applied are limited to those, such as the superconducting magnet apparatus for MRI, in which excitation/demagnetization takes place only about once a year and handling of the current lead at the time can be relied on a professional sent for that purpose. Accordingly, in case that there are a plurality of superconducting magnet apparatus of which excitation/demagnetization is performed as needed or every few days, that is, as in the case of the superconducting magnet apparatus for Maglev, if excitation/demagnetization are repeated in a range from every day to every two weeks and a plurality of superconducting magnets installed in one train are continuously excited/demagnetized one after another, manual operation of the detachable current leads will produce an enormous workload. Furthermore, there is also a safety hazard. A strong magnetic force operates on a magnetic body like an iron tool. Under the circumstance that an operator frequently works in the vicinity of a strong magnetic field of the superconducting magnet, there is a fear that the operator may be attracted by the magnet due to the magnetic body the operator accidentally carries.

On the other hand, in the gap-creating system shown in FIG. 7B, a first current lead 121 is disposed inside a vacuum container 120, and a second current lead 122 is designed to be attached to/detached from the first current lead 121. The first current lead 121 is connected to a not shown coil inside the vacuum container 120 on one end, and has a lead contact portion 121*a* on the other end. The second current lead 122 has an attachment/detachment portion 122*a* on one end which moves back and forth inside the vacuum container 120 to detachably connect itself to the lead contact portion 121*a*, and has an electrode terminal 122*b* on the other end for connecting a lead line leading to the external excitation power source outside the vacuum container 120. Airtightness inside the vacuum container 120 is maintained by an air-tight lid 125 composed of bellows, etc., disposed in close contact with the vicinity of the attachment/detachment portion 122*a* to cover a through-hole 120 which the second current lead 122 passes through.

In supplying the electric current to the coil from the external excitation power source, the attachment/detachment portion 122*a* of the second current lead 122 is connected to the lead contact portion 121*a* of the first current lead 121. When the supply of the current is completed, the second current lead 122 is moved apart from the first current lead 121, creating a gap between the attachment/detachment portion 122*a* and the lead contact portion 121*a* to produce a non-contact state.

This gap-creating system can prevent generation of frost and ice and an insulating coating by providing the contact site between the attachment/detachment portion 122*a* and the lead contact portion 121*a* in an air-tight space inside the superconducting magnet. Therefore, operation and maintenance of the superconducting magnet become easy. In case of applying the detachable current lead to the superconducting magnet where excitation/demagnetization of the magnet is comparatively frequent, adoption of this gap-creating system is indispensable.

In the gap-creating system, it is important that the air-tightness at a portion where the vacuum container is pierced is highly reliable. Particularly, in a case of the superconducting magnet used in a dynamic environment which is subject to vibration, a supporting mechanism for ensuring high vibration resistance of the air-tight lid is necessary. Conventionally, only the detachable current lead according to the pull-off system which is simple in design has been practiced. As to the gap-creating system, the detachable current lead which is operated manually without considering such a vibration environment has been proposed (see Document 3, for example).

However, such a manually operated lead has working and safety hazards as well as in the aforementioned lead according to the pull-off system. Also, it is absolutely necessary to apply a required pressing force in order to set contact electric resistance at the contact site equal to or lower than a set value. However, if the operator handles a plurality of detachable current leads very frequently by hand, there may be a shortage of the pressing force due to a human error.

Accordingly, when the detachable current lead is employed in the superconducting magnet of the superconducting magnet apparatus, not only adopting the system of creating a gap at the contact site between the attachment/detachment portion and the lead contact portion but also automation of the operator operation are required. Heretofore, there has been an idea of generating a driving force for the automation by an electric motor. Also, as a sample of only a single detachable current lead portion, there is a disclosure adopting a gas pressure driving system in order to realize the automation (see Document 5, for example).

[Document 1]

Unexamined Japanese Patent Publication No. 61-222209

[Document 2]

Unexamined Japanese Patent Publication No. 60-32374

[Document 3]

Unexamined Japanese Patent Publication No. 3-232205

[Document 4]

Shunji YAMAMOTO, et. al., "Improvement in reliability of a detachable power lead", Lecture briefs at the 42$^{nd}$ meeting on cryogenic engineering and superconductivity for 1989 Autumn, C1–4, P44 (November, 1989)

[Document 5]

Tsukasa WADA, Akio SATO, "Low heat-leaking detachable power lead", Resumes for the meeting on cryogenic engineering B3–7, P136 (May, 1987)

However, if a drive unit such as the above electric motor which generates a driving force directly by interaction between an electric current and a magnetic field is disposed in the vacuum container, loss of control or decline in the driving force is caused due to a strong magnetic field generated by the superconducting magnet. In this case, generation of the driving force is principally possible by providing a magnetic shield. However, such a magnetic shield against the strong magnetic field may increase weight of the apparatus and requires a large space. Depending on the design, it is also possible to dispose the drive unit in a vacuum. Then, the air cannot be cooled, and a sufficient amount of electric current cannot be applied in order to restrain heat generation. Consequently, the driving force becomes small and a sufficient amount of contact pressure cannot be applied to the attachment/detachment portion. In other words, a general purpose electric motor which passes a large current for power generation gives off a large amount of heat, thus causing a problem of temperature rise.

In the above gas pressure driving system, it is necessary to connect with pipes and valves a compression and vacuum (decompression) pump, a buffer tank, an expansion/contraction portion for drive (bellows), etc. for reciprocation of the attachment/detachment portion. A number of required components make the design of the apparatus complex and may increase the size and the amount as well. Moreover, if the gas pressure driving system is employed in the superconducting magnet apparatus for Maglev, gas leakage may occur in the pipes, etc. which are susceptible to vibration since traveling vibration is applied while the vehicle is traveling.

One object of the present invention which was made in view of the above problems is to provide a superconducting magnet apparatus, which renders possible efficient, accurate and secure connection of a superconducting magnet current lead.

DISCLOSURE OF THE INVENTION

In order to attain the above object, a superconducting magnet apparatus set forth in claim 1 comprises a superconducting coil cooled in a vacuum container, a first current lead fixed inside the vacuum container, one end of the first current lead being connected to the superconducting coil and the other end thereof having a lead contact portion, and a second current lead for passing through a through-hole provided in the vacuum container in an air-tight manner, one end of the second current lead being connected to a lead line leading to an external excitation power source and the other end thereof having an attachment/detachment portion detachably arranged on the lead contact portion. The superconducting magnet apparatus is switched into a persistent current mode by an electric current supplied from the external excitation power source in a condition that the above detachable portion is in contact with the lead contact portion. Then, the attachment/detachment portion is spaced apart from the lead contact portion, and the persistent current mode is maintained.

In other words, the above constitution corresponds to the aforementioned "gap-creating system". When the electric current is supplied to the superconducting coil, the attachment/detachment portion of the second current lead is brought into contact with the lead contact portion of the first electric lead to pass the electric current from the external excitation power source. After the apparatus is switched into the persistent current mode, supply of the electric current from the external excitation power source is stopped and the power source is cut off. The attachment/detachment portion is spaced apart from the lead contact portion to create a gap therebetween, and the apparatus is operated on its own. The second current lead pierces the vacuum container in an air-tight manner. Therefore, leakage of the air outside the vacuum container into the inside thereof can be prevented.

Specifically, the superconducting apparatus comprises a drive mechanism disposed in the above vacuum container. The drive mechanism is made from a nonmagnetic insulating body for automatically moving the attachment/detachment portion back and forth in an attachment/detachment direction with respect to the lead contact portion in response to a voltage applied from an external drive power source.

In the "gap-creating system" as above, the attachment/detachment portion is driven back and forth to a predetermined position not manually but automatically. Therefore, no professional skills are necessary for the operation and maintenance, and it is easy to take care of. This also eliminates a conventional safety hazard concerning the operator. Furthermore, even if a plurality of superconducting magnets have to be excited/demagnetized one after another, no manpower is required and thus the efficient operation is possible. Moreover, a required contact pressure for setting contact electric resistance at a contact site between the lead contact portion and the attachment/detachment portion, necessary for each attachment/detachment, equal to or lower than a set value can be exactly obtained without a human error.

Also, the drive mechanism made from a nonmagnetic insulating body prevents or restrains operation of the drive mechanism from being affected by a strong magnetic force of the superconducting magnet. Therefore, accurate control of moving the attachment/detachment portion back and forth is possible.

Particularly, as set forth in claim 2, the above second current lead may be like a long shaft, which is movably supported by the drive mechanism disposed on an outer face of the vacuum container along an attachment/detachment direction, and held partially in close contact with a retractable flexible member equipped to cover the above through-hole between the outer face of the vacuum container and the drive mechanism.

In such a constitution, the second current lead and the flexible member (such as bellows) are always partially in close contact with each other. Therefore, air-tightness inside the vacuum container can be secured even if the second current lead is moved.

In this regard, if leakage of gas inside the vacuum container to the outside is especially feared, as in the case that the superconducting magnet apparatus is disposed in a vibration environment, it is preferable that an air-tight chamber for forming a double leakage prevention structure as set forth in claim 3 is provided in the vacuum container.

This air-tight chamber is comprised of a tubular body, one end of which is continuously formed around the above through-hole and is extending into the vacuum container, and the other end of which movably supports and fixes the first current lead at a position spaced apart from the superconducting coil. A sealed space is created via the through-hole between the tubular body and the flexible member, and the lead contact portion and the attachment/detachment portion are accommodated inside the sealed space.

According to the above constitution, leakage of the air to the inside of the vacuum container is prevented at least double by the outer wall of the air-tight chamber disposed inside the vacuum container and the flexible member. Therefore, performance of the superconducting magnet apparatus can be maintained.

Or, the drive mechanism may be disposed inside the vacuum container instead of being disposed outside as in the above.

Particularly, as set forth in claim 4, the second current lead may comprise a shaft-like terminal portion fixed to pierce a rigid air-tight lid fixed to cover the above through-hole of the vacuum container and connected to the above lead line on one end exposed to the outside of the vacuum container, a shaft-like detachable portion slidably supported along the attachment/detachment direction by the drive mechanism inside the vacuum container, and a flexible portion composed of a lead line connecting the shaft-like terminal portion and detachable portion inside the vacuum container.

With such a constitution, since the second current lead is fixed to the rigid air-tight lid at the shaft-like terminal portion, deformation of the air-tight lid is prevented or restrained even if the superconducting magnet apparatus is disposed in the vibration environment. Thus, vibration resistance of the apparatus can be improved. Accordingly, air-tightness between the shaft-like terminal portion and the air-tight lid becomes high, and this effectively prevents leakage of the air. The attachment/detachment portion of the second current lead can be attached to/detached from the lead contact portion by a slide inside the vacuum container. Since the second current lead and the shaft-like terminal portion are in a conductive state via the flexible portion, the second current lead can adequately play a role as the second current lead.

As set forth in claim 5, an example of the above drive mechanism particularly comprises a casing disposed in the vacuum container, and a longitudinal piezoelectric element as the above nonmagnetic insulating body extending in parallel with an axis of the second current lead. One end portion of the piezoelectric element is connected to the casing and the other end thereof is connected to the above second current lead, directly or indirectly. The piezoelectric element expands/contracts in response to a voltage applied by the external drive power source, and according to the expansion/contraction, the attachment/detachment portion moves back and forth.

In the above constitution, the piezoelectric element is connected to the second current lead directly or indirectly via an intermediate. The piezoelectric element expands/contracts in parallel with the second current lead (detachable portion) according to the applied voltage. This piezoelectric element is not affected by the magnetic field. Therefore, it can move the attachment/detachment portion back and forth to an exact position, and the heat load is small. Furthermore, the drive mechanism only needs to secure a space for the piezoelectric element basically, and thus a simple and compact constitution can be attained.

Or, as set forth in claim 6, the drive mechanism may comprise a casing disposed in the vacuum container, an ultrasonic motor made from the above nonmagnetic insulating body fixed on the casing, and a slide mechanism connected to the second current lead directly or indirectly and driven in a sliding manner in parallel with the axis of the second current lead by rotation of the ultrasonic motor. The attachment/detachment portion is moved back and forth by the rotation of the ultrasonic motor via the external drive power source and driving of the slide mechanism in a sliding manner.

Such a constitution can be achieved as a slide mechanism using a ball screw which will be described in a later embodiment for example. In this case as well, since the ultrasonic motor is not affected by the magnetic field, the attachment/detachment portion can be moved back and forth to the exact position, and the heat load is small. Furthermore, there is a lot of flexibility in a moving distance of the attachment/detachment portion, compared to a case of using expansion/contraction of the aforementioned piezoelectric element. Since the moving distance can be made longer, it is possible to elongate the contact site between the first current lead and the second current lead, for example, to reduce the connection resistance.

The aforementioned superconducting magnet apparatus can be employed for various purposes, such as the superconducting magnet apparatus for MRI and the same for Maglev. Especially, this superconducting magnet apparatus can show a remarkable effect when it is used for a maglev train, as set forth in claim 7. The maglev train is provided with a plurality of superconducting magnet apparatus of which excitation/demagnetization is performed as needed or per every few days. Therefore, in the operation, promotion of efficiency in the aforementioned automation, maintaining of accuracy and operator security, etc. are extremely important.

BEST MODE FOR CARRYING OUT THE INVENTION

Preferred embodiments of the present invention will now be described for further clarification of the invention, with reference to the accompanying drawings.

[First Embodiment]

Figure 1:
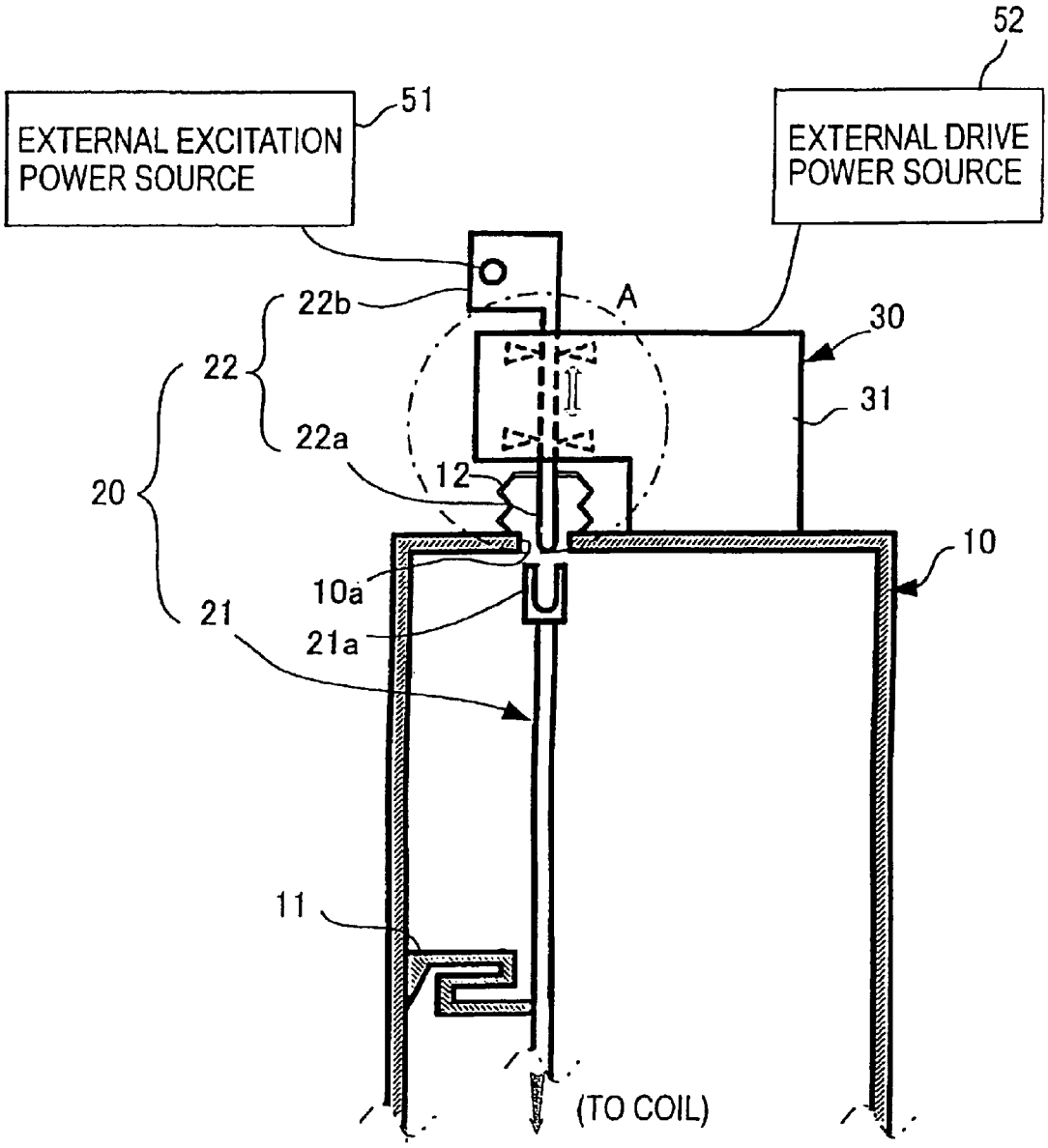
FIG. 1 is an explanatory view showing a schematic constitution of a superconducting magnet apparatus according to a first embodiment of the present invention.
Figure 2:
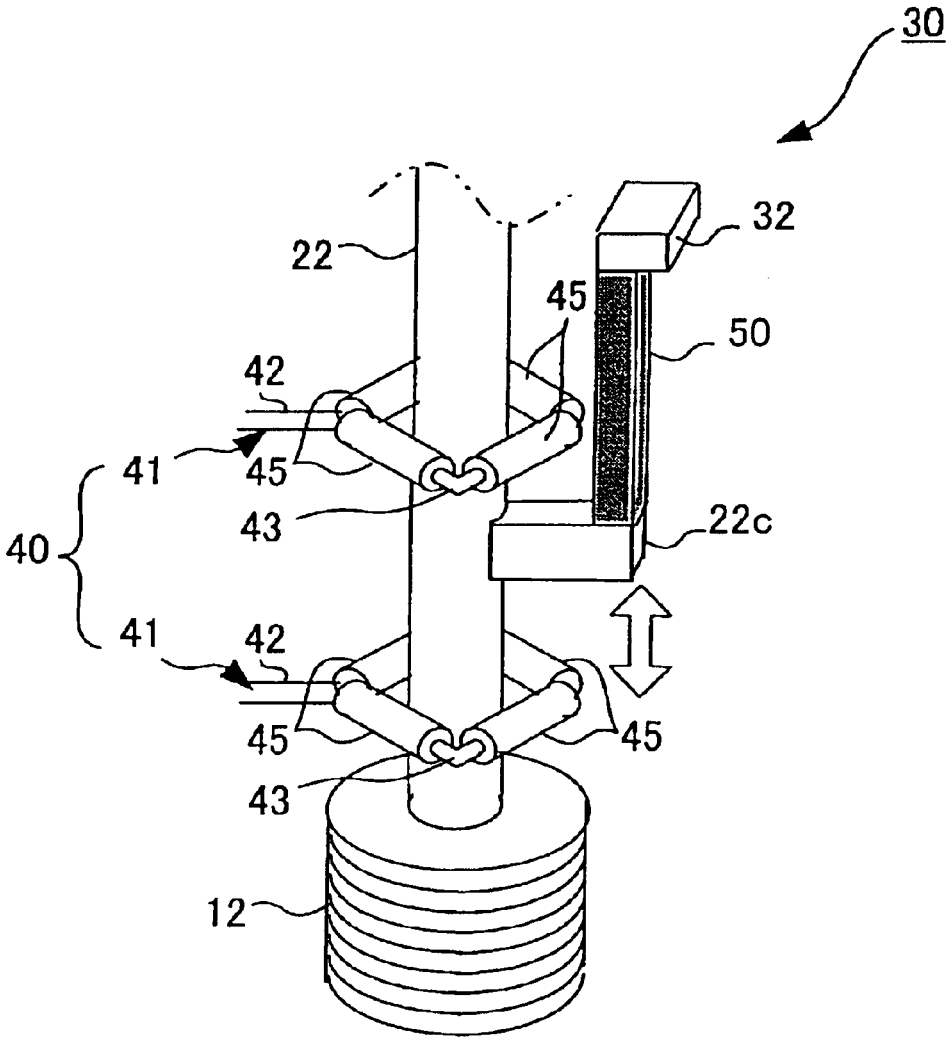
FIG. 2 is an explanatory view showing a schematic constitution of a drive mechanism which composes the superconducting magnet apparatus of the first embodiment.

The present embodiment describes a superconducting magnet apparatus for Maglev according to the present invention. FIG. 1 is an explanatory view (partial cross sectional view) showing a schematic constitution of the superconducting magnet apparatus. FIG. 2 is an explanatory view showing a particular constitution of a drive mechanism indicated in a section A (dotted line) of FIG. 1.

As shown in FIG. 1, the superconducting magnet apparatus of the present invention comprises a vacuum container 10, a superconducting coil (not shown) cooled inside the vacuum container 10, a detachable current lead 20 for supplying an electric current to the superconducting coil from an external excitation power source 51, and a drive mechanism 30 for attachment/detachment of the detachable current lead 20. Inside the vacuum container 10, there are an inner tank containing liquid helium and liquid nitrogen for cooling the superconducting coil at extremely low temperature, a radiation shield as a heat-insulating layer covering the inner tank, etc. However, explanation and diagrammatic representation of these components are omitted, since the superconducting magnet apparatus of the present embodiment features an attaching/detaching mechanism of the detachable current lead 20.

The detachable current lead 20 is composed of a first current lead 21 disposed inside the vacuum container 20 and a second current lead 22 detachably connected to the first current lead 21.

The first current lead 21 has an elongated form. The first current lead 21 is connected to the superconducting coil on one end thereof (beneath in the figure) and has a concave lead contact portion 21*a* on the other end. The first current lead 21 is fixed on and supported by a heat-insulating support body 11 provided inside the vacuum container 10 at a position spaced apart from the superconducting coil.

The second current lead 22 is like a long shaft. The second current lead 22 has an attachment/detachment portion 22*a* on one end thereof, which passes through a through-hole 10*a* provided on the vacuum container and is detachably connected to the lead contact portion 21*a*, and a terminal connection portion 22*b* on the other end, exposed to the outside of the vacuum container 10 to be connected to a lead line leading to the external excitation power source 51. The second current lead 22 is movably supported by a drive mechanism 30 disposed on an outer face of the vacuum container 10 along an attachment/detachment direction with respect to the first current lead 21. The second current lead 22 is held partially in close contact with retractable bellows 12 (flexible member) disposed between the outer face of the vacuum container 10 and the drive mechanism 30 to cover the above through-hole 10*a*.

The drive mechanism 30 expands/contracts a piezoelectric element (later-explained) accommodated inside a casing 31 by application of a predetermined voltage from an external drive power source 52. The drive mechanism 30 automatically moves the attachment/detachment portion 22*a* back and forth in the attachment/detachment direction.

In other words, as shown in FIG. 2 which is the schematic constitution of the drive mechanism 30 without the casing 31, the second current lead 22 is supported by a support mechanism 40 provided inside the casing 31 so that it can be moved back and forth in the axial direction. The support mechanism 40 is composed of a pair of upper and lower support members 41, 41 extending from an inner wall of the casing 31 toward the second current lead 22. Each of the support members 41 comprises a shaft-like portion 42 extending from the inner wall of the casing 31 and a square ring-like support portion 43 continuously formed from the tip of the shaft-like portion 42 and surrounding the second current lead 22. Each side of the support portion 43 is provided with a roller member 45 which can be rotated on the side. The roller member 45 supports the second current lead 22 so that the second current lead can moves back and forth in nonabrasive manner.

A power transmitting member 22*c* extending outward is provided on an axial middle portion of the second current lead 22. Also, one end of a longitudinal piezoelectric ceramic 50 (piezoelectric element) is connected to and supported on the support member 32 provided in a protruding condition on an inner wall of the casing 31, and the other end thereof is connected to a tip portion of the power transmitting member 22*c*. The piezoelectric ceramic 50 is arranged in such a way that it can extend in parallel to the axial direction of the second current lead 22. Therefore, it expands/contracts by application of the predetermined voltage and moves the second current lead 22 in the axial direction (attachment/detachment direction). The voltage applied at the time is determined in advance so that the attachment/detachment portion 22*a* can be brought into contact with the lead contact portion 21*a* at a necessary contact pressure, taking into account how much the piezoelectric ceramic 50 expands.

Upon switching the superconducting magnet apparatus of the present embodiment into a persistent current mode, first of all, the voltage is applied to the drive mechanism 30 from the external drive power source 52, and the piezoelectric ceramic 50 expands due to the applied voltage. In response, the second current lead 22 moves to a direction toward the first current lead 21 and the attachment/detachment portion 22*a* comes into contact with the lead contact portion 21*a*. Subsequently, an electric current from the external excitation power source 51 is supplied to the superconducting coil via the second current lead 22 and the first current lead 21.

When the switching to the persistent current mode is completed, supply of the electric current from the external excitation power source 51 is stopped, and then voltage supply from the external drive power source 52 is stopped. As a result of the above, the piezoelectric ceramic 50 contracts, and this separates the attachment/detachment portion 22*a* from the lead contact portion 21*a* and forms a gap between the first current lead 21 and the second current lead 22. The amount and timing of the power supply from the above external excitation power source 51 and the external drive power source 52 are controlled by a not shown supply power control apparatus.

As explained in the above, in the superconducting magnet apparatus of the present embodiment according to the "gap-creating system", the second current lead 22 composing the detachable current lead 20 is driven back and forth to a predetermined position not by hand but automatically to be brought into contact with the first current lead 21. Therefore, no professional skills are necessary for the operation and maintenance, and the apparatus is easy to take care of. It is also possible to eliminate a conventional safety hazard concerning the operator. Furthermore, even if a plurality of superconducting magnets are excited/demagnetized one after another, manpower is not necessary and efficient operation of the apparatus can be achieved. Moreover, the contact pressure, required for setting contact electric resistance at the contact site between the lead contact portion 21*a* and the attachment/detachment portion 22*a* necessary for each attachment/detachment equal to or lower than the set value, can be obtained accurately without a human error.

Also, since the drive mechanism is composed of the piezoelectric ceramic 50 which is a nonmagnetic insulating body, it is possible to prevent operation of the drive mechanism 30 from being affected by a strong magnetic force of the superconducting magnet. Also, reciprocation and attachment/detachment motion of the attachment/detachment portion 22*a* can be controlled accurately. Moreover, since the longitudinal piezoelectric ceramic 50 is employed, not only the drive mechanism 30 but also the superconducting magnet apparatus can be made simple and compact.

[Modification]

The above embodiment shows the support mechanism 40 which supports the second current lead 22 with a pair of upper and lower support members 41, 41 as shown in FIG. 2. However, other modes of the support mechanism are possible.

Figure 3:
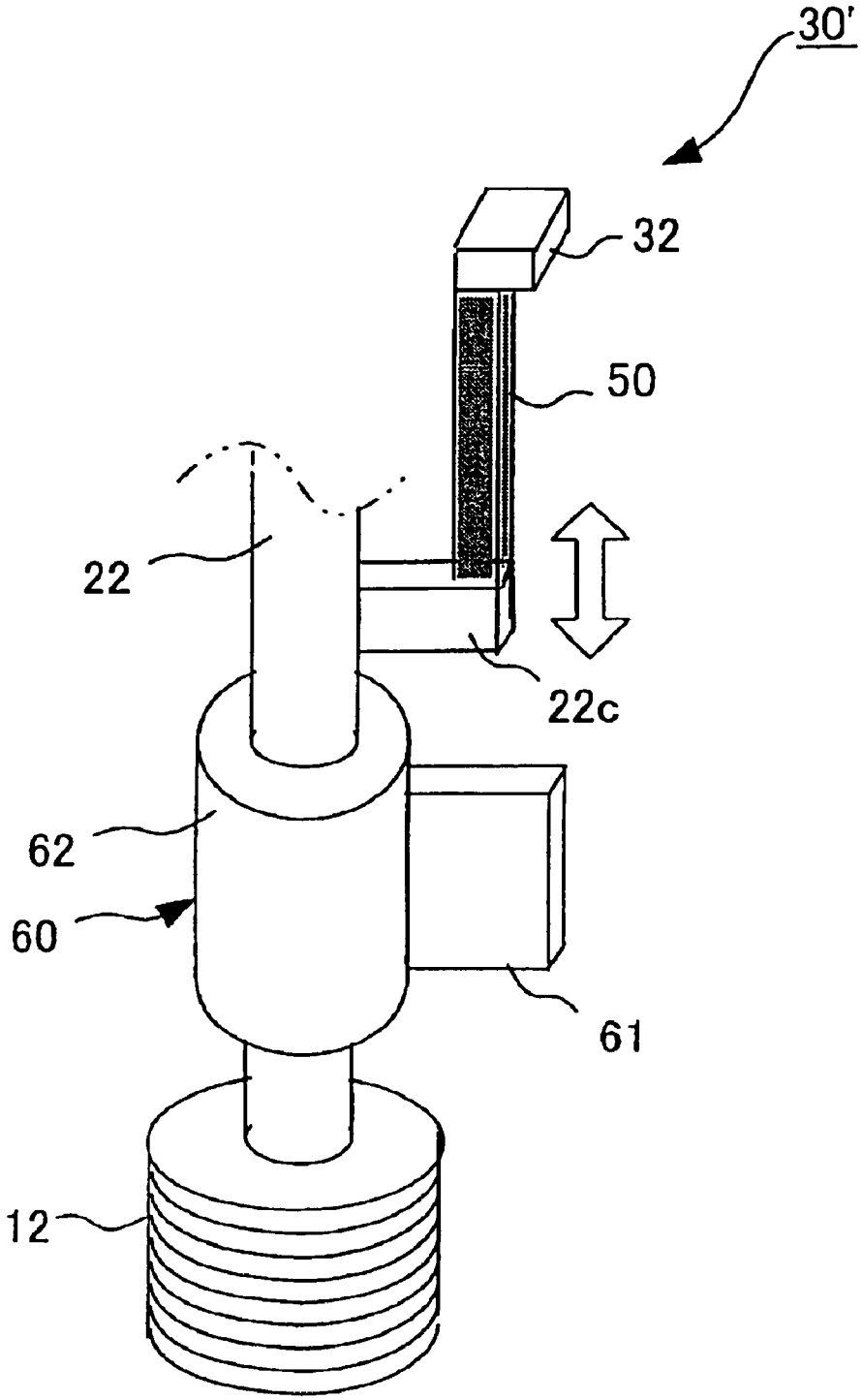
FIG. 3 is an explanatory view showing a modification of a supporting structure in the drive mechanism of the first embodiment.

For instance, as indicated in FIG. 3 showing a drive mechanism 30' according to a modification, it is also possible to employ a support structure composed of an extension portion 61 extending from an inner wall of the casing and a support portion 62 in a tubular form having a predetermined length in the axial direction of the second current lead 22 to have the same inserted therein and continuously formed from the tip of the extension portion 61. Or, to the contrary, the supporting mechanism may be designed so that the second current lead 22 is supported by at least three support members along the axial direction, and/or a plurality of support members may be designed in a different form, respectively.

[Second Embodiment]

Figure 4:
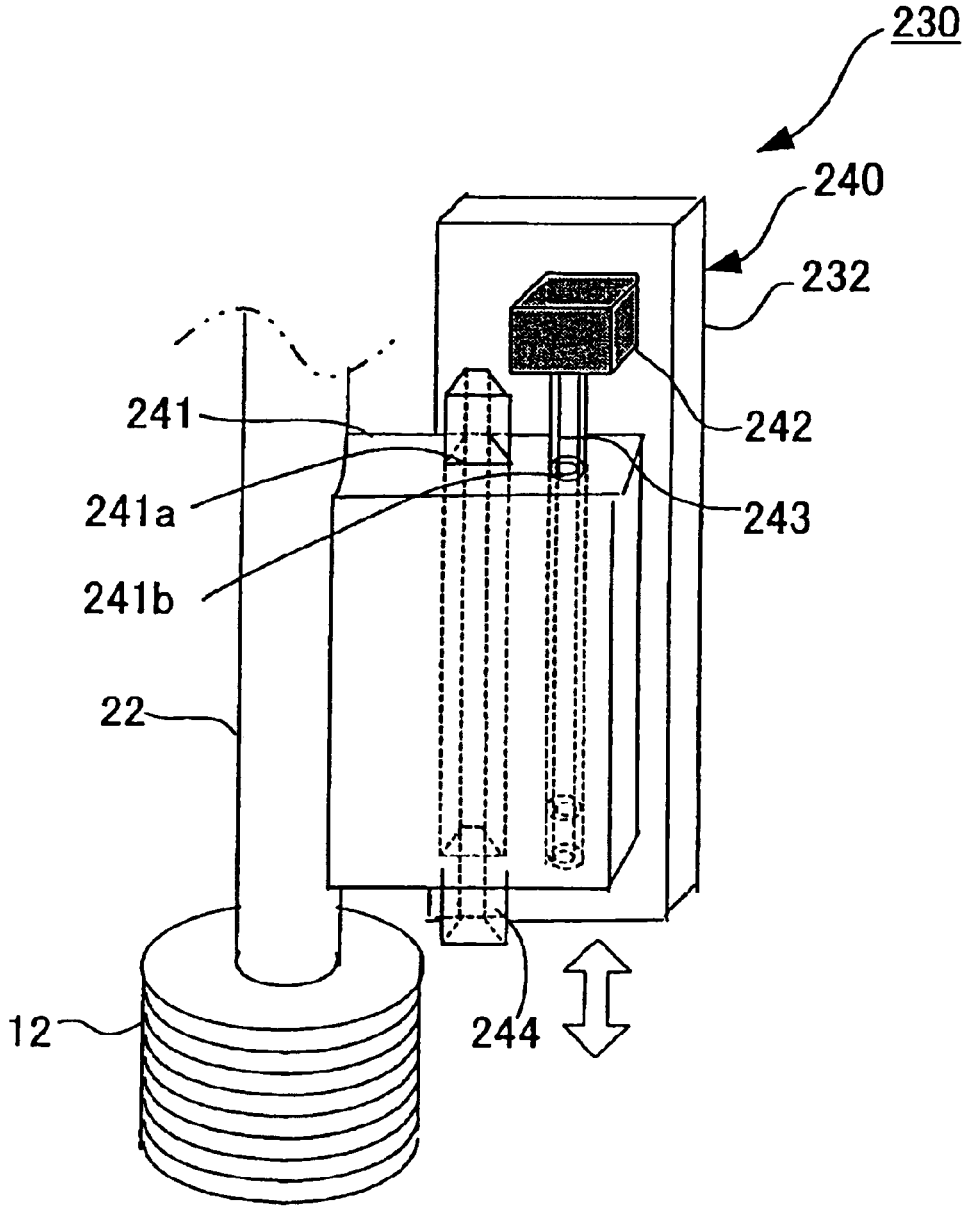
FIG. 4 is an explanatory view showing a schematic constitution of the drive mechanism composing a superconducting magnet apparatus of a second embodiment.

In the above first embodiment, the piezoelectric ceramic itself is employed as the drive mechanism. The present embodiment shows a superconducting magnet apparatus adopting a slide mechanism including an ultrasonic motor using the piezoelectric ceramic, as the drive mechanism. FIG. 4 is a schematic view of the relevant portion, which corresponds to FIG. 2 in the first embodiment. The basic constitution of the present superconducting magnet apparatus, the manner of supplying electric power, etc. are substantially identical to those in the first embodiment in principle. Therefore, the identical components may be numbered the same and explanation thereof is not repeated.

As shown in FIG. 4, the second current lead 22 is supported by a slide mechanism 240 provided inside a casing of a drive mechanism 230, and is driven back and forth in the axial direction.

This slide mechanism 240 comprises a board-like member 241 bonded to the second current lead 22 along the axial direction, an ultrasonic motor 242 disposed on a base member 232 provided on an inner wall of the casing, a ball screw 243 connected to a rotation axis of the ultrasonic motor 242 and extending in the axial direction, and a guide member 244 for guiding the board-like member 241 in parallel to the axial direction of the second current lead 22.

The board-like member 241 is provided with a guide hole 241*a* and a screw hole 241*b*. Both the guide hole 241*a* and a screw hole 241*b* are a through-hole, which is arranged in parallel to the axial direction of the second current lead 22. The guide hole 241*a* has essentially an identical cross section as the guide member 244. A female screw which engages a screw thread of the ball screw 243 is formed in the screw hole 241*b*. The guide member 244 passes through the guide hole 241*a*, and fixed to the base member 232 or fixed to the casing on both ends thereof (fixed state of the guide member 244 is not indicated on the figure for convenience). The ball screw 243 is screwed into the screw hole 241*b* and thus supports the board-like member 241 in a slidable manner.

In switching of the superconducting magnet apparatus of the present embodiment into the persistent current mode, a voltage is first supplied to the drive mechanism 230 from the external drive power source 52, and the ultrasonic motor 242 is driven to rotate the ball screw 243. As a result, the board-like member 241 slides guided by the guide member 244, and accordingly, the second current lead 22 moves toward the first current lead 21 and the attachment/detachment portion 22*a* comes into contact with the lead contact portion 21*a*. At the time when the attachment/detachment portion 22*a* comes into contact with the lead contact portion 21*a*, the voltage supply from the external drive power source 52 is stopped and the move of the second current lead 22 is stopped. Subsequently, an electric current from the external excitation power source 51 is supplied to the superconducting coil via the second current lead 22 and the first current lead 21.

When the switching to the persistent current mode is completed, the current supply from the external excitation power source 51 is stopped, and then, the voltage supply from the external drive power source 52 is started again to drive the ultrasonic motor 242 in reverse to the above. As a result of this, the ball screw 243 is rotated to an opposite direction to the above. This separates the attachment/detachment portion 22*a* from the lead contact portion 21*a* and forms a gap between the first current lead 21 and the second current lead 22. The amount and timing of power supply from the above external excitation power source 51 and the external drive power source 52, switching of the power supply direction, etc. are controlled by a not shown supply power control apparatus.

As above explained, in the superconducting magnet apparatus of the present embodiment according to the "gap-creating system" as well, the attachment/detachment portion 22*a* is driven back and forth to the predetermined position not by hand but automatically. Therefore, substantially the same effect can be obtained as in the above described first embodiment. Furthermore, since the slide mechanism 240 using the ultrasonic motor 242 is employed, there is a lot of flexibility in a moving distance of the attachment/detachment portion, compared to a case that expansion/contraction of the piezoelectric ceramic is used as in the above first embodiment. Since the moving distance can be made longer, making the contact site between the first current lead 21 and the second current lead 22 long enables reduction of the contact resistance.

[Third Embodiment]

Figure 5:
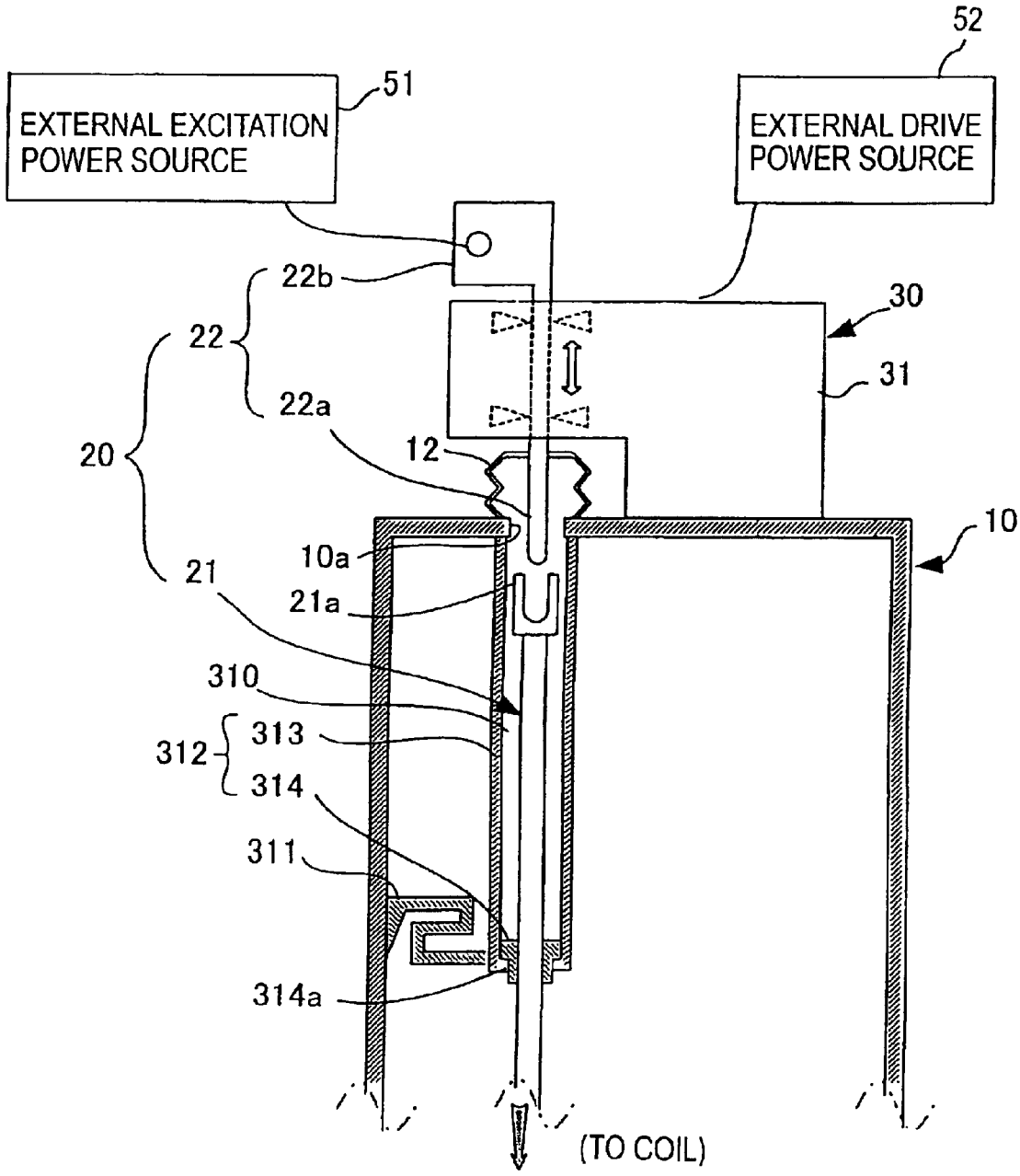
FIG. 5 is an explanatory view showing a schematic constitution of a superconducting magnet apparatus according to a third embodiment.

The present embodiment has a constitution essentially identical to that of the above first embodiment or second embodiment, and further yields high performance for preventing leakage of the air into the vacuum container. FIG. 5 is a schematic view (partial cross sectional view) of the constitution of a superconducting magnet according to the present embodiment. Since the drive mechanism in the above first embodiment or second embodiment is employed, explanation of the drive mechanism is not repeated. Similarly, the basic constitution of the present superconducting magnet apparatus, the manner of supplying electric power, etc. are substantially identical to those in the first embodiment in principle. Therefore, the identical components may be numbered the same and explanation thereof is not repeated.

As shown in FIG. 5, the superconducting magnet apparatus of the present embodiment comprises an air-tight chamber 310 comprised of a tubular body 312 provided extending inwardly (beneath in the figure) into the vacuum container 10 from the periphery of the through-hole 10*a* and having the first current lead 21 inserted therein.

This tubular body 312 comprises a tubular member 313 having a free end continuously formed around the through-hole 10*a* on an inner face of the vacuum container 10 and extending along the axial direction of the first current lead 21 inside the vacuum container 10, and a lid member 314 provided on the other end of the tubular member 313. The tubular body 312 is fixed to and supported by a heat insulating support body 311 provided inside the vacuum container 10 at the other end portion of the tubular member 313. A through-hole 314*a* is provided in the middle of the lid member 314, and the first current lead 21 passes through the through-hole 314*a* in an air-tight manner. The tubular body 312 and bellows 12 constitute the air-tight chamber 310 which forms a sealed space via the through-hole 10*a*. The lead contact portion 21*a* and the attachment/detachment portion 22*a* are accommodated inside the air-tight chamber 310.

As above explained, the superconducting magnet apparatus of the present embodiment, in addition to the constitution of the first embodiment or second embodiment, is provided with the air-tight chamber 310 in the vacuum container 10 and includes a double leakage preventive structure. Therefore, not only the same effect as in the first embodiment or second embodiment can be obtained but also double protection against leakage of the air can be achieved by the outer wall of the tubular body 312 provided inside the vacuum container 10 and the bellows 12. As a result, temperature rise due to leakage of the air, etc. specifically inside the superconducting magnet apparatus for Maglev disposed in a vibration environment can be avoided, and the performance of the superconducting magnet apparatus can be maintained.

In the present embodiment, one air-tight chamber 310 is provided to produce the double leakage preventive structure. However, more than one air-tight chamber may be provided to produce a triple or more leakage preventive structure.

[Fourth Embodiment]

Figure 6:
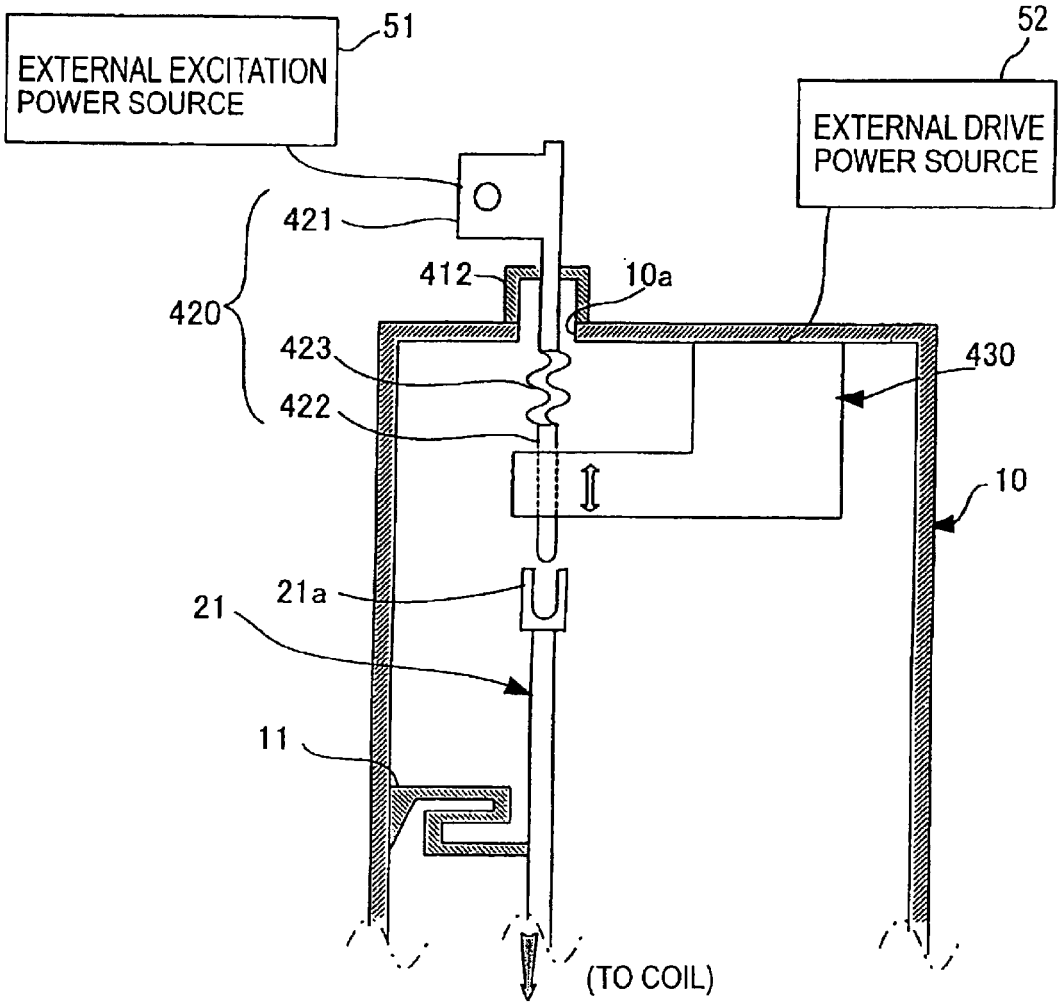
FIG. 6 is an explanatory view showing a schematic constitution of a superconducting magnet apparatus according to a fourth embodiment.
Figure 7A:
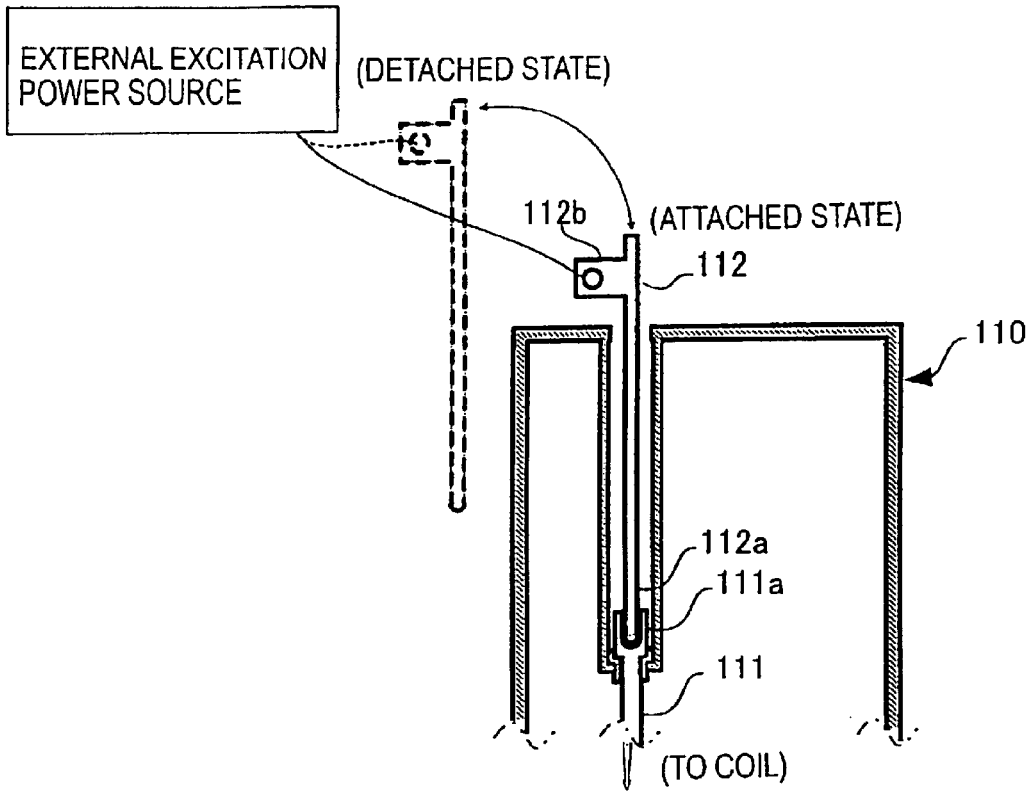
FIGS. 7A and 7B are explanatory views respectively showing a schematic constitution of a conventional superconducting magnet apparatus.
Figure 7B:
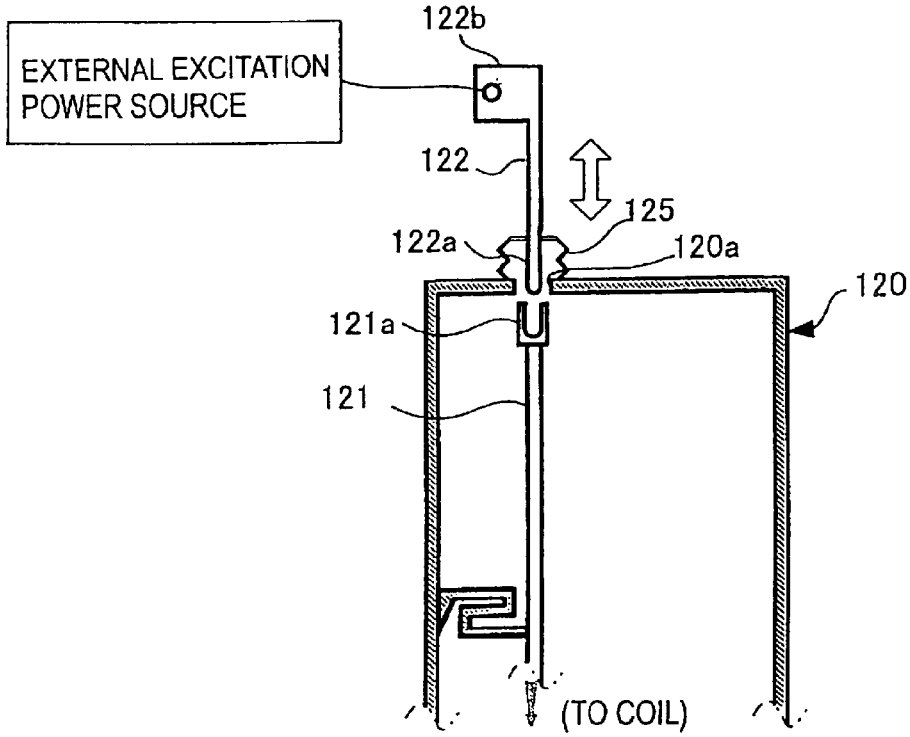

The present embodiment comprises a drive mechanism identical to that of the above first embodiment or second embodiment, but the drive mechanism is disposed not outside but inside the vacuum container 10. FIG. 6 is a schematic view (partial sectional view) of the drive mechanism of the present embodiment. Accordingly, detailed explanation of the drive mechanism is not repeated. The basic constitution of the present superconducting magnet apparatus, the manner of supplying electric power, etc. are substantially identical to those in the first embodiment in principle. Therefore, the identical components may be numbered the same and explanation thereof is not repeated.

As shown in FIG. 6, the superconducting magnet apparatus of the present embodiment has a drive mechanism 430 similar to that in the aforementioned first embodiment or second embodiment inside the vacuum container 10. A voltage is supplied from the external drive power source 52 via a lead line connected to the drive mechanism 430, which is passing through a not shown small opening bored at a portion on the vacuum container 10 where the drive mechanism 430 is disposed.

The second current lead 420 comprises a shaft-like terminal portion 421 fixed and piercing in a air-tight manner a rigid air-tight lid 412 fixed to cover the through-hole 10*a* on an outer face of the vacuum container 10, a shaft-like detachable portion 422 supported in a slidable manner by the drive mechanism 430 along the attachment/detachment direction toward the first current lead 21, and a flexible portion 423 made of a lead line electrically connecting the shaft-like terminal portion 421 and the attachment/detachment portion 422.

The attachment/detachment portion 422 of the second current lead 420 and the shaft-like terminal portion 421 are in a conduction state via the flexible portion 423. The attachment/detachment portion 422 is movably supported and driven back and forth by the drive mechanism 430 so that it can be moved inside the vacuum container 10 and attached to/detached from the lead contact portion 21*a*.

Such a constitution fixes the second current lead 420 to the rigid air-tight lid 412 at the shaft-like terminal portion 421. Therefore, even if the superconducting magnet apparatus is specifically disposed in the vibration environment, deformation of the air-tight lid 412 is prevented or restrained, and the vibration resistance can be improved. In other words, it is hard to substantially control natural frequency of the flexible air-tight lid, and if the natural frequency is included in the vibration environment, the flexible air-tight lid resonates with large deformation. However, natural frequency of the rigid air-tight lid 412 can be set substantially higher due to rigidity of the material than frequency received at the time of operation of the superconducting magnet apparatus for Maglev. Therefore, it is easy to avoid resonance and minimize deformation. If the deformation due to vibration is small, distortion of the lid becomes small, and fatigue failure which is a cause of air leakage can be prevented or restrained. Accordingly, high air-tightness between the shaft-like terminal portion 421 and the air-tight lid 412 is achieved and air leakage can be prevented effectively. Consequently, high reliability in a superconducting magnet apparatus is obtained, and cancellation of the magnetically levitated vehicle (Maglev) due to a trouble and a loss due to repair can be effectively reduced.

The embodiments of the present invention have been described in the above. However, embodiments of the present invention should not be limited to the above embodiments, and other variations might be possible without departing from the technical scope of the invention.

In the above embodiments, for instance, the piezoelectric ceramic is used as the piezoelectric element. However, piezoelectric single crystal and piezoelectric organic matter may be employed other than the piezoelectric element.

INDUSTRIAL AVAILABILITY

The present invention renders possible efficient, accurate and secured connection of a superconducting magnet current lead. It can be applied to variously-purposed superconducting magnet apparatus such as superconducting magnet apparatus for MRI and for Maglev. Specifically if employed in a maglev train, the present invention can significantly promotes efficiency by automation, maintain accuracy, and improve operator security, etc.

What is claimed is:

1. A superconducting magnet apparatus comprising:

a superconducting coil cooled inside a vacuum container;

a first current lead fixed inside the vacuum container, one end of the first current lead being connected to the superconducting coil and the other end having a lead contact portion; and a second current lead passing through a through-hole provided on the vacuum container in an air-tight manner, one end of the second current lead being connected to a lead line leading to an external excitation power source and the other end having an attachment/detachment portion detachably disposed with respect to the lead contact portion, the superconducting magnet apparatus being switched to a persistent current mode by an electric current supplied from the external excitation power source under a condition that the attachment/detachment portion is in contact with the lead contact portion, the attachment/detachment portion being then separated from the lead contact portion and the apparatus maintaining the persistent current mode, wherein the superconducting magnet apparatus further comprises a drive mechanism made from a nonmagnetic insulating body for automatically moving the attachment/detachment portion back and forth in an attachment/detachment direction with respect to the lead contact portion, in response to a voltage applied by an external drive power source.

2. The superconducting magnet apparatus as set forth in claim 1 wherein the second current lead is like a long shaft movably supported along the attachment/detachment direction by the drive mechanism disposed on an outer face of the vacuum container, and held partially in contact with a retractable flexible member arranged between the outer face of the vacuum container and the driving mechanism to cover the through-hole.

3. The superconducting magnet apparatus as set forth in claim 2 further comprising an air-tight chamber having a tubular form, one end of the air-tight chamber being continuously formed around the through-hole and extending inwardly inside, the vacuum container, the other end movably supporting and fixing the first current lead at a position spaced apart from the superconducting coil, a sealed space being created via the through-hole between the air-tight chamber and the flexible member, and the lead contact portion and the attachment/detachment portion being accommodated inside the sealed space.

4. The superconducting magnet apparatus as set forth in claim 1 wherein said drive mechanism is disposed on an inner face of the vacuum container, and said second current lead comprises:

a shaft-like terminal portion fixed to pierce a rigid air-tight lid fixed to cover the through-hole of the vacuum container and connected to the lead line on one end exposed to the outside of the vacuum container;

the attachment/detachment portion having a shaft-like form slidably supported along the attachment/detachment direction by the drive mechanism inside the vacuum container; and a flexible portion composed of a lead line connecting the shaft-like terminal portion and detachable portion inside the vacuum container.

5. The superconducting magnet apparatus as set forth in claim 1 wherein said drive mechanism comprising:

a casing; and a longitudinal piezoelectric element as the nonmagnetic insulating body extending in parallel to an axis of the second current lead, one end portion of the piezoelectric element being connected to the casing and the other end portion being connected to the second current lead directly or indirectly, wherein the attachment/detachment portion is moved back and forth by expansion/contraction of the piezoelectric element in response to a voltage applied by the external drive power source.

6. The superconducting magnet apparatus as set forth in claim 1 wherein said drive mechanism comprising:

a casing;

an ultrasonic motor made from the nonmagnetic insulating body fixed to the casing; and a slide mechanism connected to the second current lead directly or indirectly and driven in a sliding manner in parallel to the axis of the second current lead by rotation of the ultrasonic motor, wherein the drive mechanism moves the attachment/detachment portion back and forth by rotating the ultrasonic motor via the external drive power source and driving the slide mechanism in a sliding manner.

7. The superconducting magnet apparatus as set forth in claim 1 wherein said superconducting magnet apparatus is used in a magnetically levitated vehicle.

* * * * *